US005112472A

United States Patent [19]

Gosselink et al.

[11] Patent Number: 5,112,472

[45] Date of Patent: May 12, 1992

[54] PROCESS FOR CONVERTING HYDROCARBON OILS

[75] Inventors: Johan W. Gosselink; Lucas R. Groeneveld; Hennie Schaper, all of Amsterdam, Netherlands

[73] Assignee: Shell Oil Company, Houston, Tex.

[21] Appl. No.: 544,446

[22] Filed: Jun. 27, 1990

[30] Foreign Application Priority Data

Nov. 16, 1989 [GB] United Kingdom ..... 8925980

[51] Int. Cl.[5] ..... C10G 13/02; C10G 37/02

[52] U.S. Cl. ..... 208/59; 208/111; 208/49; 208/58

[58] Field of Search ..... 208/59, 111, 111 MC

[56] References Cited

U.S. PATENT DOCUMENTS

| | | | |
|---|---|---|---|
| 3,600,299 | 8/1971 | Koller | 208/59 |
| 3,686,121 | 8/1972 | Kimberlin, Jr. et al. | 208/11 MC |
| 3,702,818 | 11/1972 | Streed et al. | 208/59 |
| 3,764,520 | 10/1973 | Kimberlin, Jr. | 208/111 MC |
| 3,788,283 | 1/1974 | Buchmann et al. | 208/59 |
| 3,864,283 | 2/1975 | Schult | 208/111 MC |
| 3,894,940 | 7/1975 | Scherzer et al. | 208/111 MC |
| 4,001,106 | 1/1977 | Plank et al. | 208/59 |
| 4,183,801 | 1/1989 | Breuker et al. | 208/59 |
| 4,292,166 | 9/1981 | Corring et al. | 208/59 |
| 4,421,633 | 12/1983 | Shih et al. | 208/59 |
| 4,477,336 | 10/1984 | Scherzer | 208/111 MC |
| 4,486,296 | 12/1984 | Oleck et al. | 208/111 MC |
| 4,601,993 | 7/1986 | Chu et al. | 208/111 MC |
| 4,875,991 | 10/1989 | Kukes et al. | 208/59 |

FOREIGN PATENT DOCUMENTS 342759 5/1989 European Pat. Off. .

*Primary Examiner*—Helane E. Myers

[57] ABSTRACT

A process for converting hydrocarbon oils into products of lower average molecular weight and lower boiling point comprising contacting a hydrocarbon oil containing less than 200 ppm N at elevated temperature and pressure in the presence of hydrogen with a catalyst A comprising a wide pore zeolite, a binder and at least one hydrogenation component of a Group VI and/or Group VIII metal, wherein the hydrocarbon oil is subsequently, without intermediate separation or liquid recycle, contacted with an amorphous silica-alumina containing catalyst B comprising at least one hydrogenation component of a Group VI and/or Group VIII metal.

11 Claims, No Drawings

PROCESS FOR CONVERTING HYDROCARBON OILS

FIELD OF THE INVENTION

The present invention relates to a process for converting hydrocarbon oils into products of lower average molecular weight and lower boiling point by contacting a hydrocarbon oil containing a relatively low amount of nitrogen over a series of catalysts.

BACKGROUND OF THE INVENTION

It is known to subject a heavy hydrocarbon feedstock to a hydrocracking process which makes use of a series of catalysts.

From U.S. Pat. No. 4,435,275, it is known to hydrocrack a hydrocarbon feedstock using typically mild hydrocracking conditions by passing the feedstock firstly over a bed of an amorphous hydrotreating catalyst and subsequently, without intermediate separation or liquid recycle, passing the hydrotreated feedstock over a zeolitic hydrocracking catalyst. The zeolite in the hydrocracking catalyst can be selected from faujasite, zeolite X, zeolite Y, mordenite or zeolite ZSM-20.

The products of lower average molecular weight and lower boiling point thus obtained by hydrocracking include gaseous material, i.e. in general $C_{1-4}$ hydrocarbons, naphtha and a middle distillate fraction, i.e. a kerosene fraction and a gas oil fraction. It is evident that the cut between hydrocracked products may be made at various boiling points.

Since the gaseous products are not very much wanted and since there is an increasing demand for middle distillates, it would be advantageous to have a two-stage process available for converting hydrocarbon oils that shows a considerable selectivity towards middle distillates and a low gas make.

It has now been found that a good yield of middle distillates and low gas make can be obtained if a hydrocarbon oil containing a relatively low amount of nitrogen is passed over a catalyst system comprising a series of a catalyst which comprises a wide pore zeolite and an amorphous silica-alumina containing catalyst.

SUMMARY OF THE INVENTION

The present invention therefore relates to a process for converting hydrocarbon oils into products of lower average molecular weight and lower boiling point comprising contacting a hydrocarbon oil which contains less than 200 ppm N (nitrogen) at elevated temperature and pressure in the presence of hydrogen with a catalyst A comprising a wide pore zeolite, a binder and at least one hydrogenation component of a Group VI and/or Group VIII metal, wherein the hydrocarbon oil is subsequently contacted, without intermediate separation or liquid recycle, with an amorphous silica-alumina containing catalyst B comprising at least one hydrogenation component of a Group VI and/or Group VIII metal.

DESCRIPTION OF THE PREFERRED EMBODIMENTS

In a preferred embodiment of the process according to the present invention, catalysts A and B are applied in such a manner that the catalyst A/catalyst B volume ratio is in the range of about 0.25–4.0, preferably of about 0.5–2.0. Suitably, the amorphous silica-alumina containing catalyst B comprises silica in an amount of 10–90% by weight, preferably 20–80% by weight of total catalyst. Preferably, catalyst B comprises at least one component of nickel and/or cobalt and at least one component of molybdenum and/or tungsten or at least one component of platinum and/or palladium. Suitable catalysts B comprise commercially available catalysts.

It should be noted that in the context of the present application "wide pore zeolites" are defined as zeolites having pore diameters of at least 0.65 nm, for instance zeolites having a frame work which comprises 12-ring units, for example Y zeolite, X zeolite, zeolite $\beta$, zeolite $\Omega$ or ZSM-20, preferably Y zeolite.

Preferably, the wide pore zeolite comprises a modified Y zeolite having a unit cell size below 24.45 Å.

Preferably, the modified Y zeolite has a pore volume of at least 0.25 ml/g wherein between 10% and 60%, preferably between 10% and 40% of the total pore volume is made up of pores having a diameter of at least 8 nm.

The pore diameter distribution is determined by the method described by E. P. Barrett, G. Joyner and P. P. Halena (*J. Am. Chem. Soc.* 73, 373 (1951)) and is based on the numerical analysis of the nitrogen desorption isotherm. It should be noted that inter-crystalline voids are excluded in the determination of the percentage of the total pore volume made up in pores having a diameter of at least 8 nm when said percentage is between 10% and 40%.

It has been found that very good results can be obtained when modified Y zeolites are used having a water adsorption capacity of at least 8%, preferably at least 10% by weight on zeolite, and in particular between 10% and 15% by weight of zeolite. The water adsorption capacity, of the modified Y zeolites present in catalyst A is measured at 25° C. and a $p/p_0$ value of 0.2. In order to determine the water adsorption capacity, the modified Y zeolite is evacuated at elevated temperature, suitably about 400° C., and subsequently subjected at 25° C. to a water pressure corresponding to a $p/p_0$ value of 0.2 (ratio of the partial water pressure in the apparatus and the saturation pressure of water at 25° C.).

The unit cell size of the modified Y zeolite present in catalyst A is below 24.45 Å (as determined by ASTM-D-3492, the zeolite being present in its $NH_4^+$-form), preferably below about 24.40 Å, and in particular, below about 24.35 Å. It should be noted that the unit cell size is but one of the parameters which determine the suitability of modified Y zeolites. It has been found that also the water adsorption capacity and the pore diameter distribution as well as the crystallinity have to be taken into account in order to be able to obtain marked improvements in performance as referred to hereinbefore.

As regards crystallinity, it should be noted that the modified Y zeolites to be used in the process according to the present invention preferably retain their crystallinity (relative to a certain standard, e.g. Na-Y) when comparing crystallinity as a function of increasing $SiO_2/Al_2O_3$ molar ratio. Generally, the crystallinity will slightly improve when comparing modified Y zeolites with increasing $SiO_2/Al_2O_3$ molar ratios.

Preferably, catalyst A comprises an amount of modified Y zeolite which ranges between about 5% and about 90%, preferably between about 15% and about 50% of the combined amount of modified Y zeolite and binder.

Suitably, catalyst A comprises at least one component of nickel and/or cobalt and at least one component of molybdenum and/or tungsten or at least one component of platinum and/or palladium.

The binder(s) present in catalyst A suitably comprise(s) inorganic oxides or mixtures of inorganic oxides. Both amorphous and crystalline binders can be applied. Examples of suitable binders comprise silica. alumina, clays, zirconia, titania, magnesia, thoria, and mixtures thereof. Preference is given to the use of alumina as binder.

Depending on the unit cell size desired, the $SiO_2/Al_2O_3$ molar ratio of the modified Y zeolite will have to be adjusted. There are many techniques described in the art which can be applied to adjust the unit cell size accordingly. It has been found that modified Y zeolites having a $SiO_2/Al_2O_3$ molar ratio between about 4 and about 25 can be suitably applied as the zeolitic component of catalyst A. Preference is given to modified Y zeolites having a molar ratio between about 8 and about 15.

The amount(s) of hydrogenation component(s) in catalyst A suitably ranges between about 0.05 and about 10% by weight of Group VIII metal component(s) and between about 2 and about 40% by weight of Group VI metal component(s), calculated as metal(s) per 100 parts by weight of total catalyst. The hydrogenation component(s) may be in the oxidic and/or sulfidic form. If a combination of at least a Group VI and a Group VIII metal component is present as (mixed) oxides, it will be subjected to a sulfiding treatment prior to proper use in the present process.

Suitably, catalyst A is prepared by co-mulling the wide pore zeolite with the Group VI and/or Group VIII metal compound and the binder. Suitably, solids Group VI and/or Group VIII metal compound(s) is (are) used in the co-mulling procedure. The solid Group VI and/or Group VIII compound(s), preferably molybdenum and/or tungsten, are suitably water-insoluble. Suitable water-insoluble compounds comprise Group VI and/or Group VIII metal oxides, sulfides and acids. For example, molybdenum oxides, tungsten oxides, molybdenum sulfides, tungsten sulfides, molybdenum acid and tungsten acid. The manufacture of such compounds is known in the art.

Apart from, for instance, a molybdenum and/or tungsten compound other hydrogenation components, in particular, nickel and/or cobalt and/or platinum and/or palladium may be present in catalyst A. Such other hydrogenation components can suitably be added to the co-mulling mixture in the form of a solution containing the hydrogenation components. Preferably, the hydrogenation components are selected from the group consisting of nickel, cobalt, molybdenum and tungsten. In particular the hydrogenation-metal is nickel and/or cobalt, most preferably it is nickel. The solution is advantageously an aqueous solution. It will be understood that catalyst A may also suitably be prepared by means of various conventional methods, i.e. ion-exchange or impregnation. The co-mulling can suitably be carried out in the presence of a peptizing agent, such as an acid, e.g. a mineral acid or acetic acid. Shaping of the catalyst A particles can be done in any method known in the art. A very convenient way to shape the particles is by extrusion.

The process according to the present invention is preferably carried out over catalyst A in the presence of hydrogen and at a temperature of about 250°-500° C. and at a pressure of about 20-300 bar, more preferably at a temperature of about 300°-450° C. and a pressure of about 90-200 bar.

The process according to the present invention is preferably carried out over catalyst B in the presence of hydrogen and at a temperature of about 250°-500° C. and a pressure of about 20-300 bar, more preferably at a temperature of about 300°-450° C. and a pressure of about 90-200 bar.

Preferably, catalysts A and B are applied in a stacked-bed configuration.

Feedstocks which can suitably be applied in the process according to the present invention comprise all sorts of hydrocarbonaceous feedstocks as long as they fulfil the requirement to contain less than 200 ppm N. Suitably, the feedstocks comprise gas oils, vacuum gas oils, deasphalted oils, long residues, catalytically cracked cycle oils, coker gas oils and other thermally cracked gas oils and syncrudes, optionally originating from tar sands, shale oils, residue upgrading processes or biomass or combinations thereof, which may have been hydrotreated before being contacted with catalyst A. The feedstocks can for instance suitably be contacted with alumina containing hydrotreating catalyst prior to contact with catalyst A.

Preference is made to hydrocarbon oils which contain less than 50 ppm N (nitrogen), more preferably less than 30 ppm N (nitrogen).

Preferably, the process according to the present invention is carried out in such a way that part of the effluent, in particular substantially unconverted material, from catalyst B is recycled to catalyst A.

The present invention will now be illustrated by means of the following Examples which are illustrative and are not intended to be construed as limiting the invention.

EXAMPLE I a) Composition of a stacked-bed which comprises a first bed of catalyst A and a second bed of catalyst B, whereby both catalysts are in calcined form.

Catalyst A comprises 11% by weight of a modified Y zeolite having a unit cell size of 24.32 Å, a water adsorption capacity (at 25° C. and a $p/p_0$ value of 0.2) of 11.0% by weight, a nitrogen pore volume of 0.47 ml/g wherein 27% of the total pore volume is made up of pores having a diameter of at least 8 nm, 62.5% by weight of aluminum oxide (ex Condea), 5% by weight of nickel and 16% by weight of tungsten.

Catalyst A has been prepared by co-mulling a mixture comprising a modified Y zeolite, hydrated aluminum oxide, acetic acid, water, nickel nitrate solution and ammonium metatungstate.

Catalyst B comprises 83.5 % wt of amorphous silica-alumina (ex American Cyanamid). 3.6% by weight of nickel and 7.9% by weight of molybdenum. The stacked-bed has a catalyst A/catalyst B volume ratio of 1.

b) An experiment was carried out in accordance with the present invention by subjecting the stacked-bed as described hereinabove to a hydrocracking performance test involving a hydrotreated heavy vacuum gas oil having the following properties:

| | |
|---|---|
| C (% wt) | 86.64 |
| H (% wt) | 13.25 |
| S (ppm) | 75 |

-continued

| | |
|---|---|
| N (ppm) | 13 |
| d (70/4) | 1.4716 |
| I.B.P. (°C.) | 325 |
| 10/20 | 381/406 |
| 30/40 | 426/443 |
| 50/60 | 461/478 |
| 70/80 | 497/519 |
| 90 | 547 |
| F.B.P. | >548 |

The stacked-bed was firstly subjected to a presulfiding treatment by slowly heating in a 10% v $H_2S/H_2$-atmosphere to a temperature of 370° C. Both catalysts A and B were tested in a 1:1 dilution with 0.2 mm SiC particles under the following operation conditions: WHSV 0.75 kg/l/hr, $H_2S$ partial pressure 3 bar, total pressure 130 bar and a gas/feed ratio of 1500 Nl/kg. The experiment was carried out in once-through operation. The temperature required for 70% conversion of the 370+ fraction was noted, whereafter the temperature was adjusted to obtain a 80% conversion of the 370° C. fraction.

The following results were obtained: Temperature required (70% conv. of 370° C.+): 360° C. Distribution of 370 ° C.− product (in % by weight) at 80% conversion:

| | |
|---|---|
| $C_1$-$C_4$ | 3 |
| $C_5$-150° C. | 33 |
| 150° C.-370° C. | 64 |

COMPARATIVE EXAMPLE

An experiment was carried out in substantially the same manner as described in Example I except that a catalyst bed (in volume essentially equal to the volume of the stacked bed as described in Example I) was used comprising a catalyst as described hereinbelow.

The catalyst used comprises 8.4% by weight of a modified Y zeolite having a unit cell size of 24.32 Å a water adsorption capacity (at 25° C. and a $p/p_0$ value of 0.2) of 11.0% by weight a nitrogen pore volume of 0.47 ml/g wherein 27% of the total pore volume is made up of pores having a diameter of at least 8 nm. 50.2% by weight of amorphous silica-alumina (ex American Cyanamid), 25% by weight of aluminium oxide (ex Condea), 3% by weight of nickel and 10% by weight of tungsten. The catalyst has been prepared by co-mulling a mixture comprising a modified Y zeolite, amorphous silica-alumina, hydrated aluminum oxide, acetic acid, water, nickel nitrate solution and ammonium meta tungstate.

The following results were obtained: Temperature required (70% conv. 370° C.+): 358° C. Distribution of 370° C.− product (in % by weight) at 80% conversion:

| | |
|---|---|
| $C_1$-$C_4$ | 5 |
| $C_5$-150° C. | 37 |

-continued

| | |
|---|---|
| 150° C.-370° C. | 58 |

It will be clear from the above results that the experiment according to the present invention yields less gaseous material ($C_1$-$C_4$) and more middle distillates (150° C.−370° C.), than the comparative experiment which is not according to the present invention.

What is claimed is:

1. A process for converting hydrocarbon oils into products of lower average molecular weight and lower boiling point comprising contacting a hydrocarbon oil which contains less than 200 ppm N at a temperature of about 250° C. to about 500° C. and a pressure of about 20 bar to about 300 bar in the presence of hydrogen with a catalyst A comprising zeolite Y having a unit cell size below 24.45 Å, a binder and at least one hydrogenation component selected from the group consisting of a Group VI metal, a Group VIII metal, and mixtures thereof, wherein the hydrocarbon oil is subsequently contacted at a temperature of about 250° C. to about 500° C. and a pressure of about 20 bar to about 300 bar, without intermediate separation or liquid recycle, with an amorphous silica-alumina containing catalyst B comprising at least one hydrogenation component selected from the group consisting of a Group VI metal, a Group VIII metal, and mixtures thereof, wherein catalysts A and B are present such that the catalyst A/catalyst B volume ratio is in the range of from about 0.25 to about 4.0.

2. The process of claim 1 wherein catalyst B comprises silica in an amount of from about 10% by weight to about 90% by weight.

3. The process of claim 1 wherein the binder comprises an inorganic oxide or mixture of inorganic oxides.

4. The process of claim 1 wherein the modified Y zeolite has a degree of crystallinity which is at least retained at increasing $SiO_2/Al_2O_3$ molar ratios.

5. The process of claim 4 wherein the modified Y zeolite has a water adsorption capacity (at 25° C. and a $p/p_0$ value of 0.2) of at least 8% by weight of modified Y zeolite.

6. The process of claim 5 wherein the modified Y zeolite has a pore volume of at least 0.25 ml/g wherein between 10% and 60% of the total pore volume is made up of pores having a diameter of at least 8 nm.

7. The process of claim 1 wherein catalyst A comprises an amount of modified Y zeolite which ranges between 5 and 90% of the combined amount of modified Y zeolite and binder.

8. The process of claim 1 wherein the hydrogenation component comprises at least one component selected from nickel and/or cobalt and at least one component selected from the group consisting of molybdenum, tungsten, platinum, palladium and mixtures thereof.

9. The process of claim 1 wherein catalyst A has been prepared by co-mulling the wide pore zeolitic catalyst with a Group VI and/or Group VIII metal compound and the binder.

10. The process of claim 1 wherein part of the effluent from catalyst B is recycled to catalyst A.

11. The process of claim 1 wherein catalysts A and B are applied in a stacked-bed configuration.

* * * * *